US009080460B2

(12) United States Patent
Amcoff et al.

(10) Patent No.: US 9,080,460 B2
(45) Date of Patent: Jul. 14, 2015

(54) TURBINE CLEANING SYSTEM

(75) Inventors: Henrik Amcoff, Naoka (SE); Sebastian Nordlund, Solna (SE)

(73) Assignee: EcoServices, LLC, Farmington, CT (US)

( * ) Notice: Subject to any disclaimer, the term of this patent is extended or adjusted under 35 U.S.C. 154(b) by 1179 days.

(21) Appl. No.: 12/633,354

(22) Filed: Dec. 8, 2009

(65) Prior Publication Data

US 2010/0243001 A1 Sep. 30, 2010

Related U.S. Application Data

(60) Provisional application No. 61/164,582, filed on Mar. 30, 2009.

(51) Int. Cl.

| | |
|---|---|
| ***B08B 3/00*** | (2006.01) |
| ***F01D 25/00*** | (2006.01) |
| ***B08B 3/02*** | (2006.01) |

(52) U.S. Cl.

CPC ..... *F01D 25/002* (2013.01); *B08B 3/02* (2013.01); *F05D 2220/50* (2013.01)

(58) Field of Classification Search

None

See application file for complete search history.

(56) References Cited

U.S. PATENT DOCUMENTS

| | | | | |
|---|---|---|---|---|
| 1,935,806 | A * | 11/1933 | Mautsch | 74/98 |
| 5,148,715 | A * | 9/1992 | Blaser et al. | 74/325 |
| 5,702,175 | A * | 12/1997 | Chen | 362/191 |
| 7,428,906 | B2 | 9/2008 | Asplund et al. | |
| 7,445,677 | B1 * | 11/2008 | Asplund | 134/24 |
| 7,454,913 | B1 | 11/2008 | Tassone et al. | |
| 2008/0040872 | A1 | 2/2008 | Hjerpe | |

FOREIGN PATENT DOCUMENTS

| | | |
|---|---|---|
| EP | 1903188 | 3/2008 |
| EP | 1 489 269 B1 | 6/2008 |
| EP | 1927408 | 6/2008 |
| JP | 50-104862 | 8/1975 |
| JP | 52019166 A | 2/1977 |
| RU | 2323051 | 4/2008 |
| WO | WO 96/40453 | 12/1996 |
| WO | WO 97/27927 | 8/1997 |
| WO | WO 2005/120953 A1 | 12/2005 |
| WO | WO2007032738 | 3/2007 |

OTHER PUBLICATIONS

Japanese Office Action, mailed Mar. 27, 2012.

* cited by examiner

*Primary Examiner* — Jason Ko

(74) *Attorney, Agent, or Firm* — Kinney & Lange, P.A.

(57) ABSTRACT

A spray cleaning device for cleaning an auxiliary power unit (APU) within an aircraft comprises one or more spray nozzles, a water tube for supplying water to the nozzles, and positioning means. A system for cleaning APUs comprises a spray cleaning device and a supply system for providing pressurized and temperature controlled washing fluid to the cleaning device. A method for cleaning APUs comprises providing a spray cleaning device, attaching the cleaning device to an air inlet structure of an aircraft, and supplying washing fluid to the cleaning device at a desired spray pressure, spray temperature, and spray droplet size.

20 Claims, 8 Drawing Sheets

TURBINE CLEANING SYSTEM

CROSS REFERENCE TO RELATED APPLICATIONS

This Application claims priority to U.S. Provisional Patent Application No. 61/164,582, entitled "Turbine Cleaning System," filed on Mar. 30, 2009, the contents of which are incorporated herein in its entirety.

TECHNICAL FIELD

The present disclosure relates to systems and methods for cleaning turbines, in particular auxiliary power units (APU) in aircrafts. The cleaning may occur on-site and/or on-line (i.e. when the APU is running at full power).

BACKGROUND

Gas turbines in general, and perhaps aircraft engines in particular, are exposed to many kinds of fouling during operation. The fouling is caused by material that is sucked into the turbine via its air inlet. The material can be of many kinds such as particles from exhaust gases, insects, larger animals such as birds, atmospheric pollution such as soot, etc. All these materials adhere to turbine blades and form fouling coatings that adversely affects the operation of the turbine, by decreasing the air flow of the turbine's compressor, thereby decreasing the overall performance of the gas turbine.

Compressor cleanliness can be maintained using a routine program of water washing. Two such water wash maneuvers performed on gas turbines are referred to as off-line and on-line, respectively. An off-line maneuver is conducted with the gas turbine in a cooled state using cranking speed, while an on-line maneuver is conducted with the gas turbine at operating temperature. This on-line maneuver typically uses water only. Both washing maneuvers use highly atomized water spray patterns designed to completely enter a turbine's compressor core. The off-line cleans the entire core and recovers lost performance, while the on-line cleans the early stages of the core and maximizes the time period between needed off-line washings.

Known systems for washing turbines are directed to cleaning engine turbines on aircrafts, or stationary industrial turbines. Cleaning APUs, however, which are provided for generating electricity to aircrafts during stops at airports, has not been addressed by the known systems.

Instead, it is common practice to dismantle an APU from the aircraft and either replace it, or to clean it separately and re-mount it into place.

As can be appreciated by those in the art, such a procedure is fairly tedious, and as a result, there is a tendency to allow large time intervals lapse between cleaning/replacement of APU's. As a consequence, an APU can lose some of its power generating ability, thereby requiring more fuel which adds to the cost of operation of the aircraft.

SUMMARY

In view of the problems with current washing methods and systems, there exists a need to improve the washing of APUs in aircrafts, and in particular, to reduce down-time and to improve the performance of APUs to have higher efficiency over an extended period of time as compared to today.

Thus, one aspect of the present disclosure is to provide a cleaning apparatus, system, and method for efficiently cleaning one or more APUs on-site (without removing it from the aircraft) and/or on-line (while the APU is running at full power).

In one example, a spray cleaning device is provided for cleaning APUs on-site and on-line. In another example, there is provided a system for cleaning APUs on-site and on-line, which system includes a spray cleaning device. In yet another example, a method of cleaning APUs is provided.

Further scope of applicability of the present disclosure will become apparent from the detailed description given hereinafter and the accompanying drawings which are given by way of illustration only, and thus not to be considered limiting.

DETAILED DESCRIPTION

The present disclosure is based on the idea that by providing a high pressure water spray having suitable properties that can be injected through the air inlet for an APU, it will be possible to clean the APU both on-line and off-line without having to dismantle the APU from an aircraft.

A spray cleaning device, according to an embodiment, in its most general form, comprises at least one nozzle capable of generating a controlled spray of atomized water at a desired pressure and at a desired volume flow. Suitably, the spray parameters are variable such that the pressure may be set to between 20 and 200 Bar, the droplet size, in the atomized spray, may be set to between 40 and 250 μm, and the volume flow may be set to between 1 and 20 l/minute (depending on engine maintenance manual allowed flow rate).

The actual parameter values to be used will vary with the type of APU to be cleaned, the amount of fouling present in the APU, whether the APU is to be cleaned on-line or off-line, and/or various other factors. One skilled in the art will be able to adapt the parameters to the APU in question.

A spray cleaning device according to the embodiment also comprises a rigid tube portion which carries the nozzle(s). In case of a single nozzle, one piece of rigid tube may be used to hold the nozzle in place. If the cleaning device comprises several nozzles, the tube may be branched in various directions such that the position of each nozzle will be as desired with respect to the APU being cleaned. Alternatively, multiple rigid tubes may be used to house the several nozzles.

In an alternate embodiment, the nozzle(s) and/or rigid tube portion may be integrated into an elongated supply tube for supplying the required high pressure liquid to the APU. This elongated tube may also be used to form a handle for an operator.

In order to place the nozzle(s) in a correct position with respect to the interior of an APU, there is provided a positioning means on the cleaning device. This positioning means, in its simplest design, comprises a member that is designed to conform and mate with a portion of an aircraft's APU air inlet. In this manner, the remainder of the cleaning device can simply be rested in position against the aircraft body, thereby providing support for keeping the nozzle(s) in a fixed position. For added stability, an operator may apply additional pressure to the cleaning device to counterbalance reaction forces of the spray when the cleaning device is in operation.

Alternatively, the positioning means can be designed as a clamp. As a result, the cleaning device may temporarily be fixated to the aircraft body in a very secure manner without added pressure from an operator, thereby freeing the operator to monitor the washing operation instead.

The clamp may be designed in numerous ways, and may be adapted to conform to the body of each specific aircraft model, particularly since APUs are built into different aircrafts at different positions.

Figure 1:
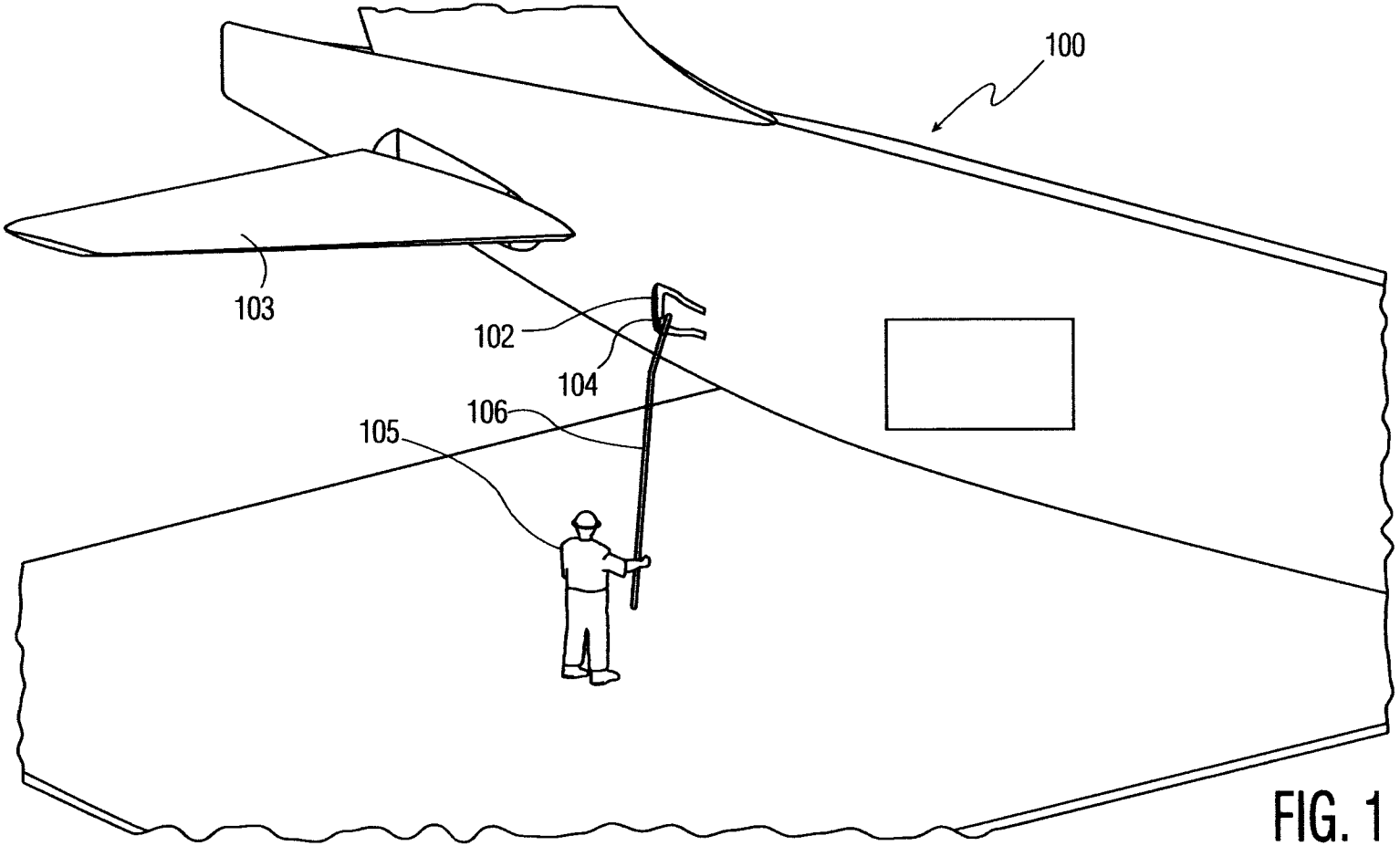
FIG. 1 shows the tail of an exemplary aircraft with an air inlet to one APU shown and an operator using a spray device according to an embodiment.

Turning now to FIG. 1, a tail portion of an exemplary aircraft 100 (e.g., Boeing 737) is shown. In this aircraft 100, the APUs, one on each side, are located inside the aircraft body (not shown). The air inlets 102 to the APUs are provided on either side of the aircraft 100 just in front of the rear wings 103. Also shown in FIG. 1 is a cleaning operator 105 using a spray cleaning device 104 according to an embodiment (the water supply system for providing high pressure water is not shown). As shown in FIG. 1, the spray cleaning device 104 is operated from the ground while the operator 105 holds the cleaning device 104 with his hands. Due to the elongated water supply pipe 106, the air inlet 102 for the APU can be used to access the turbine for cleaning purposes without the need of ladders or lift devices.

Figure 2:
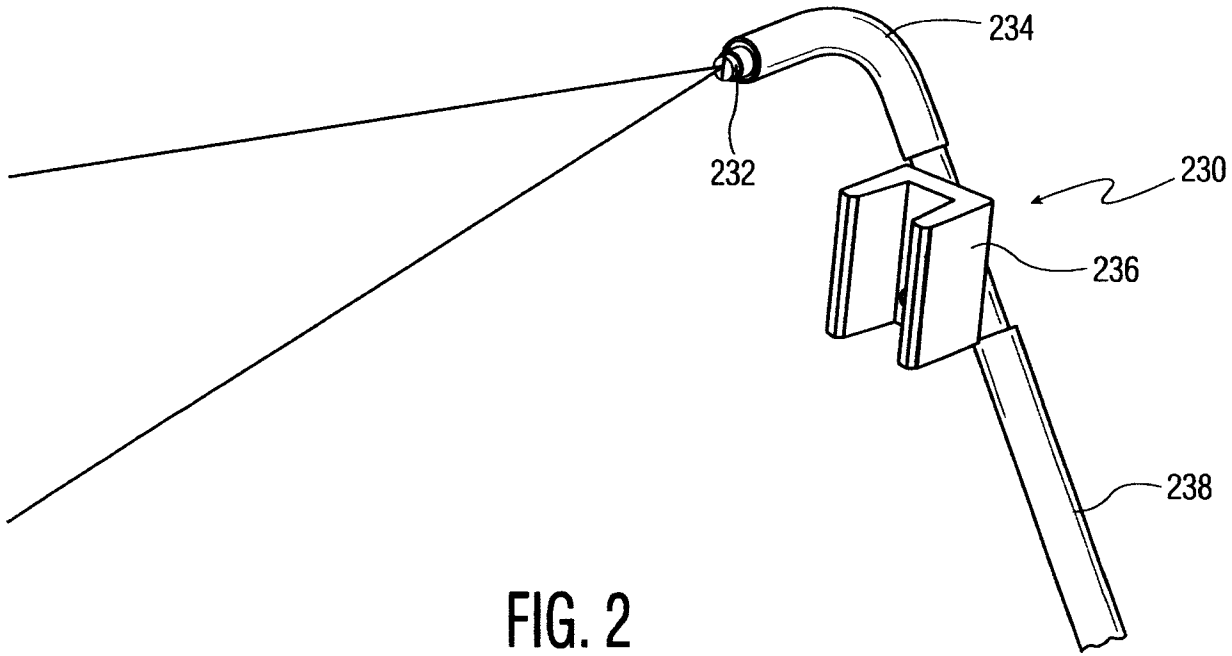
FIG. 2 shows an exemplary first embodiment of a spray device.

FIG. 2 illustrates an exemplary embodiment of a spray cleaning device 230. The device 230 comprises a spray nozzle 232, the design of which will be discussed in more detail below. The nozzle 232 is attached to a nozzle tube 234 (i.e. a tube carrying the nozzle), which is shown bent at a bending angle of about 90°, although other angles may be appropriate for specific applications, mainly depending on the design of the APU, and/or its position in an aircraft body. The bending radius of the tube 234 is not critical, but should of course be such that liquid flow there through is not restricted.

Attached to the tube 234 is an adjustable positioning means 236. In this embodiment, the positioning means 236 is shown as a generally "U"-shaped member, wherein the inner "walls" of the member are configured to conform with the air inlet wall structure of an aircraft. It should be understood, however, that this positioning means 236 may be configured according to any desired shape, and to confirm to any mounting location.

The spray nozzle carrying tube 234 is attached to (or integral with) a water supply tube 238 at the distal end thereof. Washing fluid (e.g., water or other washing fluid, such as detergents) from a fluid source (not shown) may be injected through the water supply tube 238, up through the nozzle tube 234, and out through the nozzle(s) 232. As is shown, the positioning means 236 is rigidly connected to the nozzle tube-water supply tube assembly 234-238 with an angled orientation. In this manner, upon mounting the spray device 230 to an aircraft inlet, the spray nozzle(s) 232 will already be aimed in the desired direction. In another embodiment, the positioning means 236 may be loosely connected to the nozzle tube-water supply tube assembly 234-238, in which case the nozzle(s) 232 may be positioned after the spray device 230 has been mounted. In such an embodiment, once the nozzle(s) 232 are aimed in a desired direction, the positioning means 236 may be tightened and/or locked in place.

Figure 3:
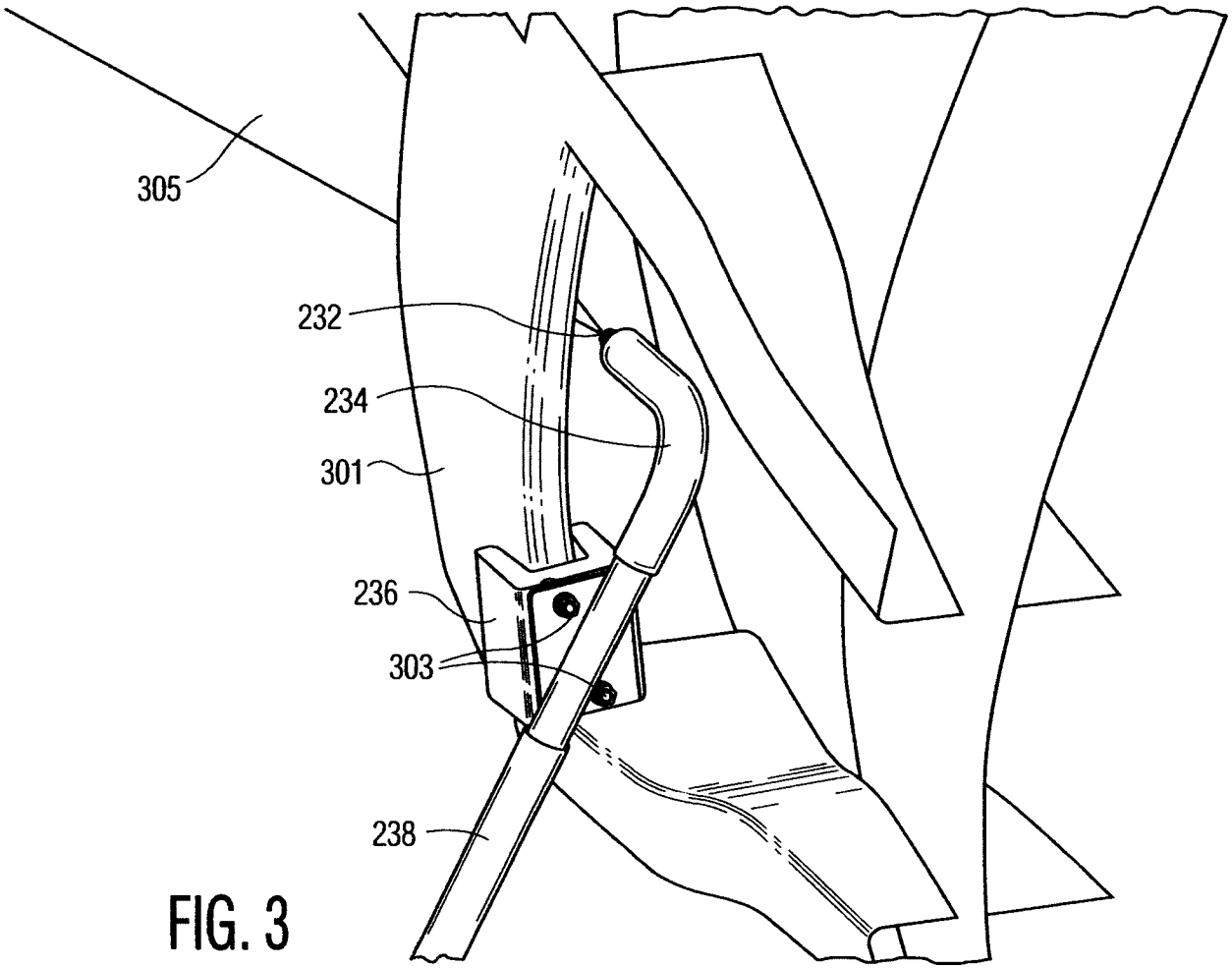
FIG. 3 shows the exemplary spray device of FIG. 2, mounted to an exemplary APU air inlet.

Turning now to FIG. 3, the exemplary spray device 230 according to FIG. 2 is shown in a mounted position at an air inlet 301. As shown, the spray device 230 has been mounted directly onto an edge of the air inlet 301. The positioning means 236 is shown accommodating an edge of the air inlet 301 to form a firm, temporary connection between the air inlet 301 and the spray device 230. Also shown are two bolts 303 on a back side of the positioning means 236. These bolts 303 are used to fixedly connect the positioning means 236 to the nozzle tube-water supply tube assembly 234-238. As noted above, this enables the spray nozzle(s) 232 to be in a proper orientation once the spray device 230 has been mounted. It should be noted, however, that any known means for fixedly attaching the positioning means 236 to the nozzle tube-water supply tube assembly 234-238 may be utilized without departing from the scope of the embodiment. Once the spray device 230 is securely mounted to the air inlet 301, wash fluid 305 from a fluid source (not shown) is injected into the water supply tube 238 and forced through the nozzle tube 234, out of the nozzle(s) 232, and into the APU.

Figure 4:
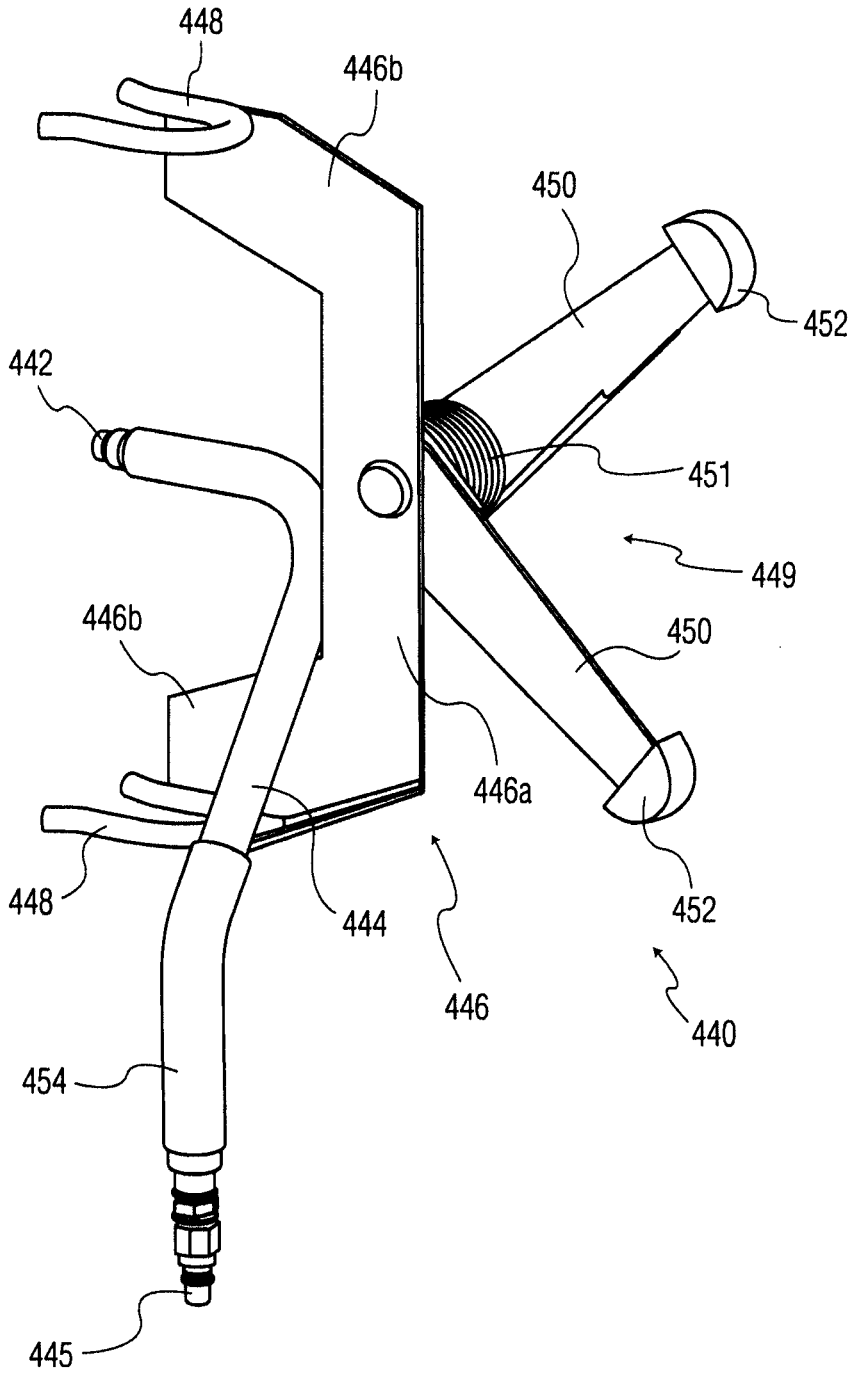
FIG. 4 shows a second exemplary embodiment of a spray device.

FIG. 4 illustrates an exemplary embodiment of a spray device 440. This exemplary embodiment is designed to be rigidly fixed at an air inlet. As a result, it will be possible to use flexible hoses for water supply.

The exemplary spray device 440 comprises one or more nozzles 442, which are attached to a nozzle tube 444, which is bent at a bending angle of about 90°. The tube 444 is coupled to a further tube section 454 having a hose connection 445 for coupling a flexible hose or other water supply tube to the device 440.

There is also provided a support member 446 comprising a main body portion **446*a* having two wing portions 446*b* at respective ends thereof. The support member 446 is suitably made of sheet metal, although any other rigid material may be used. In one embodiment, the support member 446** may be constructed from tubes.

The nozzle tube 444 is rigidly attached, e.g. via welding, to the main body portion **446*a* of the support member 446, so as to provide a fixed position of the nozzle(s) 442** with respect to an APU when mounted.

On each wing portion **446*b* of the support member 446 there is attached a positioning bracket 448. These brackets 448 may be essentially "U"-shaped, as shown, or any other appropriate shape for conforming to the contour of an edge of an APU air inlet, and for holding the spray device 440** in a fixed position in both lateral and vertical directions.

In order to prevent spray forces from forcing the spray device 440 away from its desired mounting position, there is provided a fixation means 449. This fixation means 449 ensures that no uncontrolled movement occurs by abutting to parts of the air inlet structure (not shown) with a sufficient force to prevent any unwanted movement. This can be achieved either purely by friction forces on the aircraft body at the air inlet, or by a part of the fixation means 449 actually abutting some part of the aircraft body to hinder backwards movement of the spray device 440.

In the particular embodiment shown in FIG. 4, the fixation means 449 comprises two spring-loaded arms 450 arranged in a "V" configuration. The arms 450 are connected via a torsion spring 451 which provides a torsion force that urges the arms 450 to move apart so as to widen the "V". Optionally, end stops are provided to prevent the arms 450 from widening too much. Suitably, the maximum deflection could be set to correspond to a slightly larger span than the width of the space in which they are to be clamped. The ends of each arm 450 are preferably provided with a rubber cap 452 to provide friction when abutting the aircraft body.

In an alternative embodiment, one of the arms 450 may be rigid, while the other arm 450 may be spring-loaded by the torsion spring 451.

Figure 5A:
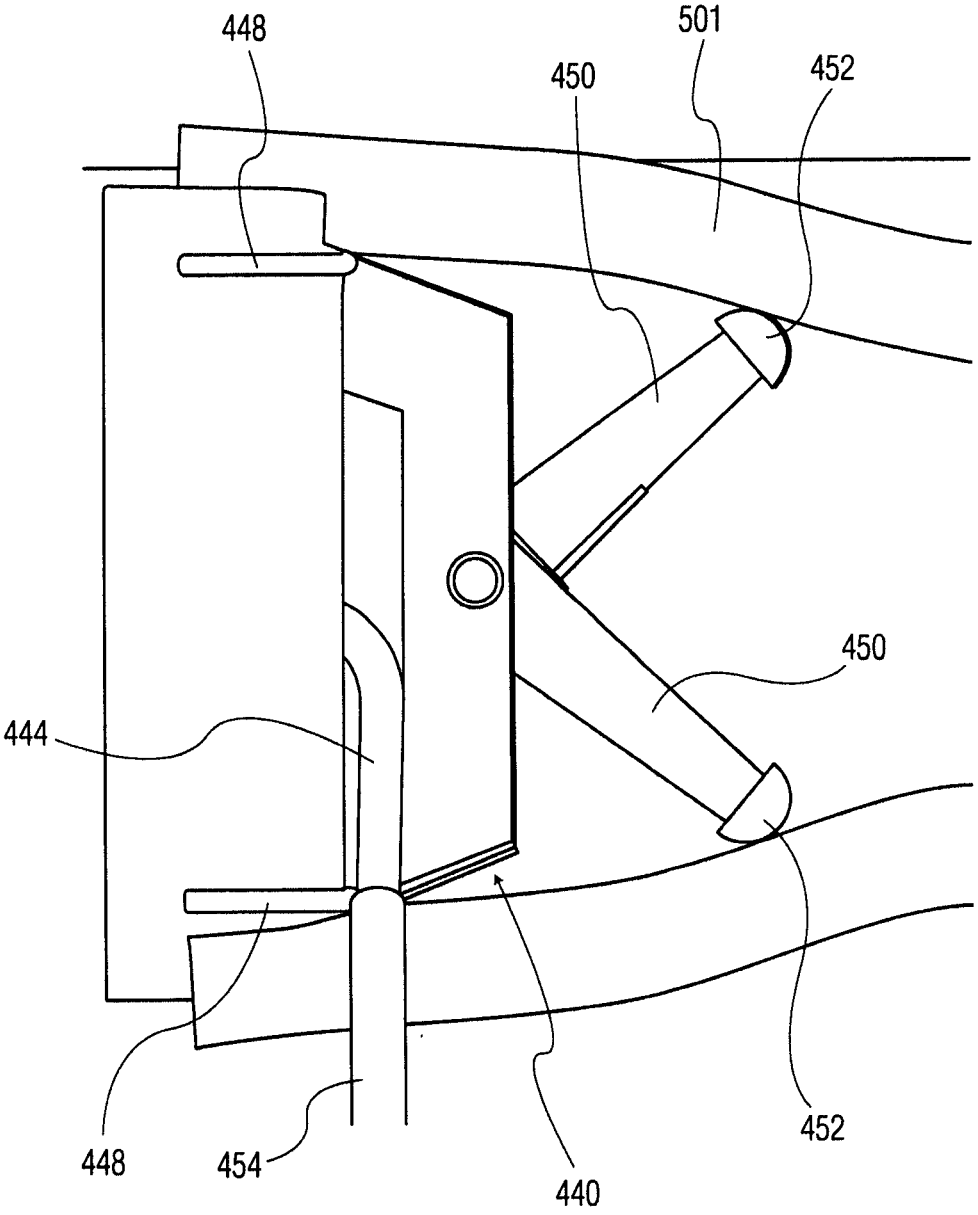
FIG. 5*a* shows the exemplary embodiment of FIG. 4, in a mounted state.

FIG. 5*a* shows the exemplary device 440 described with respect to FIG. 4, mounted at an air inlet 501 to an APU of an aircraft. As can be seen, the torsion spring (not shown) forces the arms 450 against a part of the structure of the air inlet 501. The friction between the rubber caps 452 and the air inlet 501 together with the torsion spring force create a reaction force that is large enough to withstand the force from water spray as it travels through the wash fluid and nozzle tubes 454, 444. In FIG. 5*a*, the air inlet 501 comprises surfaces that have a slight inclination which helps in creating the reaction force. However, even in a case where there is only an essentially horizontal air inlet surface for the arms 450 to rest against, the friction from the rubber caps 452 and the force from the torsion spring may suffice to keep the spray device 440 in place during operation. In order to mount the spray device 440, or to reposition the spray device 440, the arms 450 may be forced towards each other and when the spray device 440 is in position, the arms 450 may be released to exert a force against the surface of the air inlet 501.

Figure 5B:
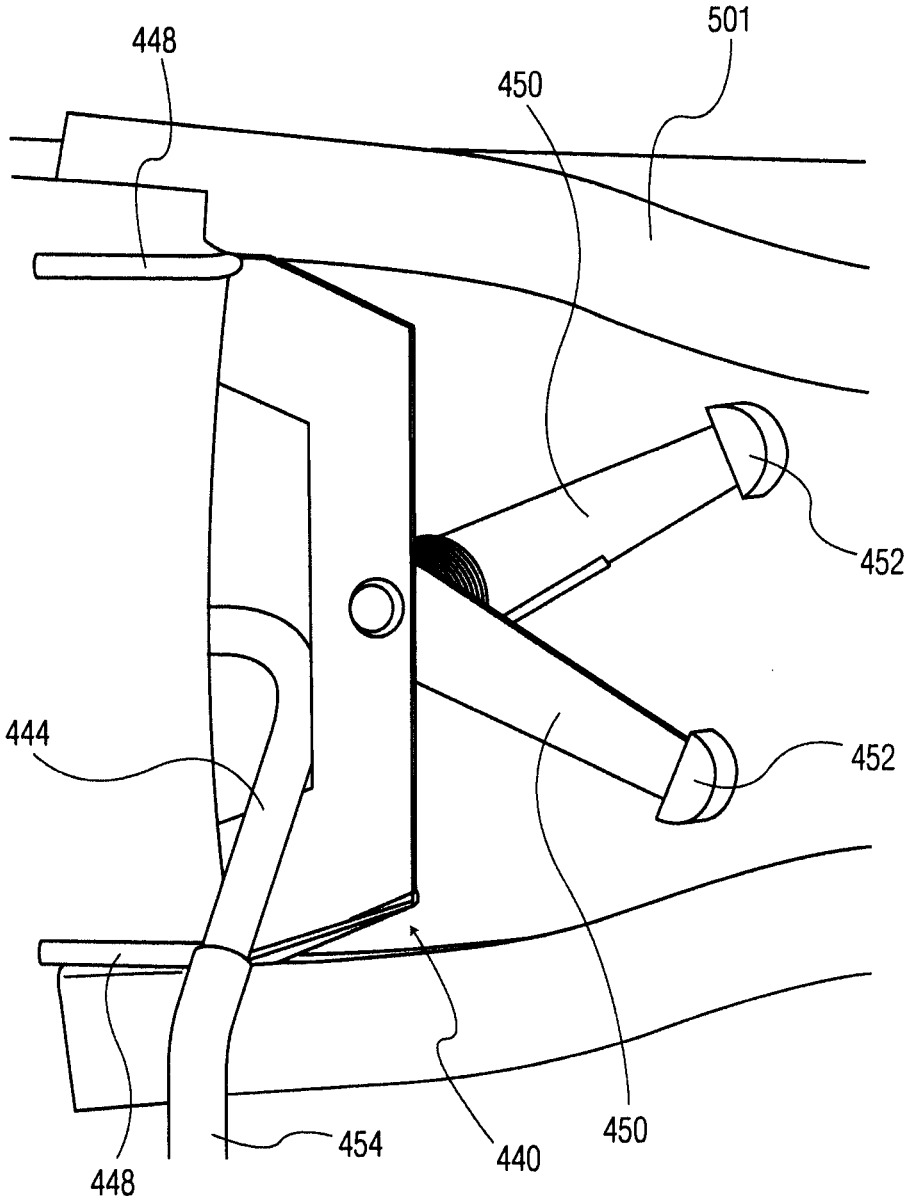
FIG. 5*b* shows the exemplary embodiment of FIG. 4, in a pre-mounted state during insertion.

When the spray device 440 is in a mounted position, as in FIG. 5*a*, the arms 450 press against the air inlet 501 and hold the spray device 440 in place. To remove the spray device 440, the arms 450 may be forced towards each other against the spring force, as indicated in FIG. 5*b*, thereby removing the friction force from the air inlet 501.

Figure 6:
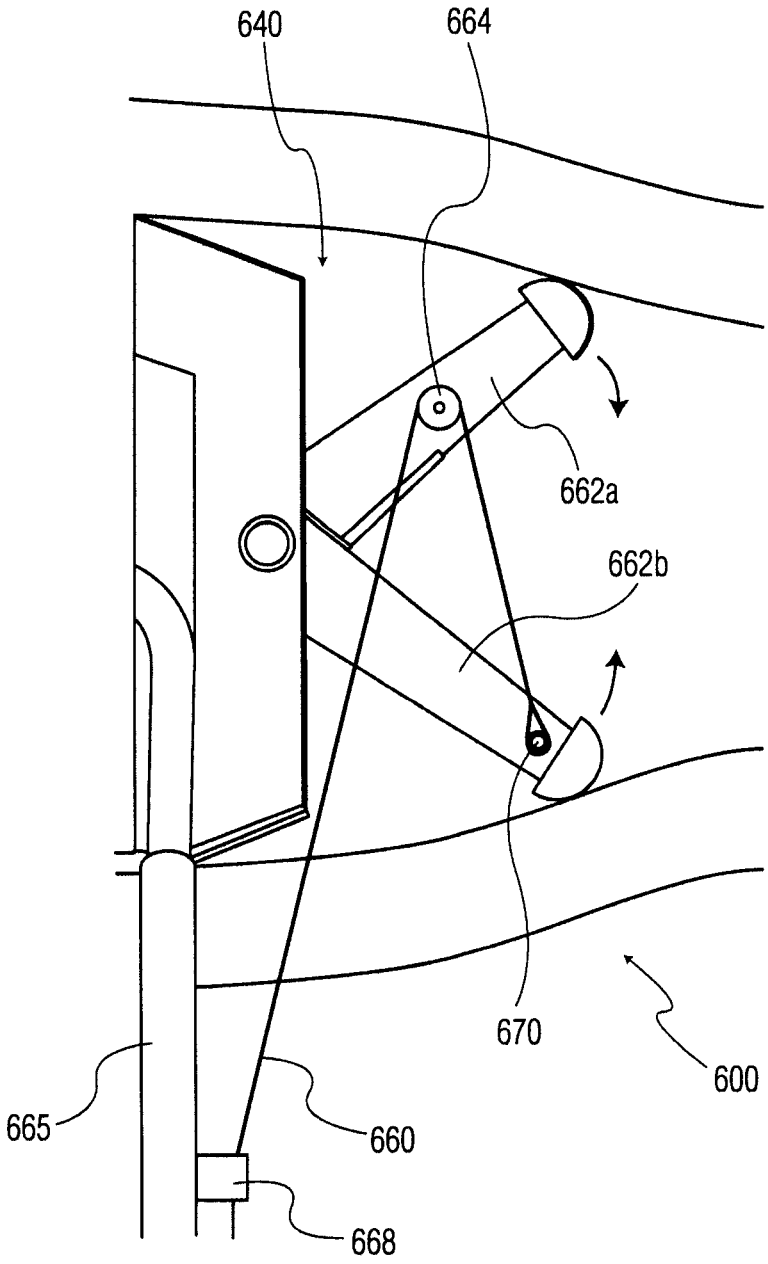
FIG. 6 shows an embodiment of a mechanism for remotely controlling a spray device.

In an alternate embodiment, a spray device may comprise a remote control means for enabling an operator to remotely mount, dismount, and/or position the spray device. An exemplary remote control means 600 is shown in FIG. 6. As shown, the remote control means 600 comprises a wire 660 coupled to arms 662*a*, 662*b* of an exemplary spray device 640 in such a way that by pulling the wire 660, the arms 662*a*, 662*b* are forced towards each other. The wire 660 may be attached to the lower arm 662*b* at attachment point 670, and looped around a pulley wheel 664 on the upper arm 662*a*, or through a loop or a hole in the upper arm 662*a* (not shown). The wire 660 may then be pulled along the tube 665 in suitable guide members/structures, which in one embodiment could be implemented in the form of short tube segment(s) 668 attached to the tube 665. When the wire 660 is pulled, the wire 660 will cause the lower arm 662*b* to move upwards and the upper arm 662*a* to move downwards (as shown by the arrows in the figure), thereby reducing the gap between the arms 662*a*, 662*b*. Once the wire 660 is released, the arms 662*a*, 662*b* will move apart from one another, creating tension against an air inlet structure.

In an alternative embodiment, a motor and a gear mechanism (not shown) may be provided for mechanically opening and closing the arms 662*a*, 662*b*. This motor/gear mechanism could then be controlled by a remote operator. The motor, similar to the wire 660 could be used to drive the arms 662*a*, 662*b* in opposite directions either inwards to release them from a mounted position, or outwards to lock them in position.

Figure 7:
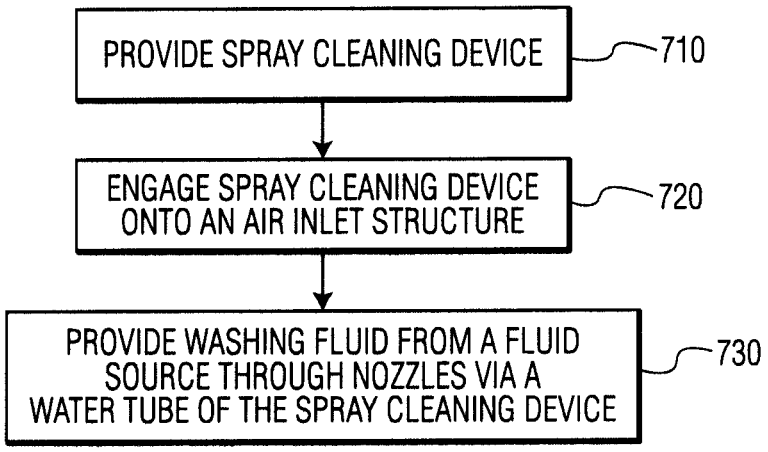
FIG. 7 shows an embodiment of a method for cleaning one or more APUs.

With reference to the flowchart of FIG. 7, a method for cleaning one or more APUs is provided. As an initial step 710, a novel spray cleaning device, as disclosed herein, is provided. The cleaning device may comprise one or more nozzles for spraying washing fluid onto one or more APUs, a water tube for supplying washing fluid to said nozzles, and a positioning means for positioning the one or more nozzles in a desired orientation. The positioning means may optionally further comprise a clamping member adapted to engage an air inlet structure of an aircraft. Optionally, the positioning means may also include a support member, for use in holding the spray cleaning device against a portion of the aircraft body. Connected to an end of the water tube may be a rigid elongated tube made of any suitable rigid material, or a flexible hose made of any suitable flexible tubing. Optionally, the rigid elongated tube may be telescopically extendable, thereby enabling an operator to raise and lower the spray cleaning device.

Once the spray cleaning device is provided, at 720, it may be engaged onto an air inlet structure of the aircraft via the clamping member. Optionally, if the positioning means includes a support member, an operator may hold the support member against a portion of the aircraft body. As will be appreciated by those in the art, utilizing the support member in this manner will provide further stability and support to the cleaning device while in operation. Indeed, depending on the implementation, the support member may be utilized without having to engage the clamping member at all.

At 730, after the spray cleaning device has been properly engaged, washing fluid from a fluid source may be provided through the nozzles via the water tube at a desired spray pressure, spray temperature, and spray droplet size.

Optionally, as noted above, the spray cleaning device may include two arms in a V-configuration. In such an embodiment, the method may further comprise urging the two arms together, positioning the spray cleaning device, and then releasing the two arms. If the arms are spring loaded, the force generated as a result of the spring loading will cause the two arms to move apart and against portions of the aircraft. Preferably, the spring loading is selected to provide sufficient force to maintain the spray cleaning device stable and in position during a washing operation. In embodiments where a remote control mechanism is used to operate the arms, the method may further comprise manually or mechanically urging the two arms apart prior to position the spray cleaning device, and then releasing the two arms to engage portions of the aircraft.

Upon completing the washing operation, the spray cleaning device may be removed from the air inlet structure via unclamping the clamping member, releasing the support member, and/or urging the two arms together, depending on which form of spray cleaning device is implemented.

The foregoing examples are provided merely for the purpose of explanation and are in no way to be construed as limiting. While reference to various embodiments are shown, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

The invention claimed is:

1. A spray cleaning device for cleaning an auxiliary power unit (APU) located inside the body of an aircraft, said cleaning device comprising:

one or more spray nozzles arranged to spray into an air intake of the APU;

a water tube for supplying water to said nozzles, said nozzles being attached to a distal end portion of said water tube; and positioning means rigidly connected to said water tube and adapted to engage with an APU air inlet for positioning the nozzles inside the aircraft body statically with respect to the APU.

2. The spray cleaning device of claim 1, wherein said positioning means comprises a clamping member adapted to engage with a structure on the aircraft body to clamp the spray cleaning device in a desired position.

3. The spray cleaning device of claim 1, wherein said positioning means comprises a support member adapted to be held against a selected part of the aircraft body for holding the spray cleaning device firmly in a desired position without clamping it to the aircraft body.

4. The spray cleaning device of claim 1, wherein said positioning means is connected to a distal rigid portion of the water tube.

5. The spray cleaning device of claim 1, and further comprising:

at least one of a rigid elongated tube and a flexible hose removably connected to the water tube.

6. The spray cleaning device of claim 5, wherein said rigid elongated tube is telescopically extendable.

7. The spray cleaning device of claim 1, wherein said distal end portion of the water tube is curved so as to direct the one or more spray nozzles to a desired location in the APU to be cleaned.

8. The spray cleaning device of claim 1, wherein the water tube is branched to provide at least two rigid distal end portions, each comprising at least one spray nozzle.

9. The spray cleaning device of claim 8, wherein the at least two rigid end portions are adapted for independent positioning of the nozzles.

10. The spray cleaning device of claim 2, wherein the clamping member comprises two arms in a V-configuration, at least one of said arms being spring-loaded.

11. The spray cleaning device of claim 10, wherein both arms are spring-loaded.

12. The spray cleaning device of claim 10, wherein spring force resulting from the spring loaded arms urges said arms apart.

13. The spray cleaning device of claim 12, further comprising means for urging the arms towards each other against the spring force.

14. The spray cleaning device of claim 10, wherein each arm comprises friction increasing means.

15. The spray cleaning device of claim 10, further comprising a remote control means for urging the arms towards each other.

16. The spray cleaning device of claim 15, wherein said remote control means comprises a wire fixedly attached to a first of the arms and looped around a pulley attached to a second of the arms, wherein downward tension on the wire causes the first and second arms to move towards each other.

17. The spray cleaning device of claim 15, wherein said remote control means comprises at least one gear attached to at least one of the arms, and a motor attached to the at least one gear for driving said gear, wherein operating the motor drives the at least one gear such that the arms are urged together.

18. A system for cleaning an auxiliary power unit (APU) in aircrafts with bodies, comprising:

a spray cleaning device, comprising:

one or more spray nozzles arranged to spray into an air intake of the APU;

a water tube for supplying water to said nozzles, said nozzles being attached to a distal end portion of said water tube; and a positioning means rigidly connected to said water tube for positioning the nozzles inside the aircraft body with respect to the APU, wherein the positioning means comprises two arms in a V-configuration, at least one of said arms being spring-loaded; and a supply system for providing pressurized and temperature controlled washing fluid to the spray cleaning device.

19. The system of claim 18, wherein the supply system delivers washing fluid at a pressure of 30-85 Bar, a temperature of −70 degree C., and with a spray droplet mean size of 40-250 mum.

20. The system of claim 18, wherein distal ends of the arms are positioned stationary in the aircraft body to position the nozzles inside the aircraft body.

* * * * *